US006508373B1

(12) United States Patent
Robinson

(10) Patent No.: US 6,508,373 B1
(45) Date of Patent: Jan. 21, 2003

(54) CHILD RESISTANT CONTAINER AND CLOSURE, PACKAGE AND METHOD OF ASSEMBLY HAVING A LOCKING TAB ON THE CONTAINER AND A CAM STOP LUG ON THE CLOSURE

(75) Inventor: Philip J. Robinson, Sylvania, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 99 days.

(21) Appl. No.: 09/692,944

(22) Filed: Oct. 20, 2000

(51) Int. Cl.[7] ..... B65D 50/08
(52) U.S. Cl. ..... 215/209; 215/218; 215/221
(58) Field of Search ..... 215/201, 209, 215/216–221, 330; 220/281, DIG. 34

(56) References Cited

U.S. PATENT DOCUMENTS

| | | | | |
|---|---|---|---|---|
| 3,019,931 A | | 2/1962 | Thornton | |
| 3,233,769 A | * | 2/1966 | Jessop | 215/215 |
| 3,881,625 A | * | 5/1975 | Landen | 215/209 |
| 3,884,379 A | * | 5/1975 | Landen | 215/216 |
| 3,892,326 A | | 7/1975 | Schneible | |
| 3,939,788 A | * | 2/1976 | Schneible | 215/216 |
| 4,036,385 A | | 7/1977 | Morris | |
| 4,144,983 A | * | 3/1979 | Pauls et al. | 215/216 |
| 4,427,124 A | | 1/1984 | Marshal | |
| 5,031,784 A | | 7/1991 | Wright | |
| 5,544,768 A | | 8/1996 | Gargione | |
| 5,711,442 A | * | 1/1998 | Kusz | 215/209 |
| 5,727,703 A | * | 3/1998 | Fuchs | 215/214 |
| 5,816,422 A | | 10/1998 | Roig | |
| 5,899,348 A | * | 5/1999 | Konefal et al. | 215/209 |
| 5,941,402 A | * | 8/1999 | Krueger | 215/209 |
| 6,039,195 A | | 3/2000 | Konefal | |

* cited by examiner

*Primary Examiner*—Nathan J. Newhouse
*Assistant Examiner*—Robin A. Hylton

(57) ABSTRACT

A child resistant container and closure package includes a container of one-piece integrally molded plastic construction having a cylindrical finish, a shoulder connecting the finish to a side wall, a ring externally extending around the finish, and a tab extending from the ring and separated from the finish by a tangential slot. A stop lug is cantilevered from the tab and has oppositely oriented stop and cam faces. One or two ribs extend tangentially along an undersurface of the tab. A closure has a base wall with a peripheral skirt and an internal thread for securement to an external thread on the container finish. A pair of diametrically opposed internal lugs on the skirt have circumferentially oriented compound cam surfaces to cooperate with a cam surface on the stop lug on the container tab to bend the stop lug as the closure is applied to the container finish, and a circumferentially oriented abutment surface to cooperate with a stop face on the container stop lug against removal of the closure from the container finish absent depression of the container tab toward the container shoulder. The ribs extending tangentially along the undersurface of the tab function both to strengthen the tab during such depression and as an abutment stop against the container shoulder during bending depression of the tab to remove the closure.

13 Claims, 4 Drawing Sheets

CHILD RESISTANT CONTAINER AND CLOSURE, PACKAGE AND METHOD OF ASSEMBLY HAVING A LOCKING TAB ON THE CONTAINER AND A CAM STOP LUG ON THE CLOSURE

The present invention is directed to container and closure packages that resist opening by a child, and more particularly to a container and a closure for such a package, and to a method of manufacturing such a package, container and closure.

BACKGROUND AND SUMMARY OF THE INVENTION

A number of child resistant container and closure packages have been proposed in the art. In general, these packages require simultaneous application of force in two directions in an effort to defeat opening by a child. However, opening of the packages should not require excessive force or dexterity, so that the packages can be opened by elderly or infirm persons. It is a general object of the present invention to provide a child resistant container and closure package, a container and a closure for such a package, and a method of making such a package, container and closure, which may be implemented inexpensively and that require minimal application and removal force.

A child resistant container and closure package in accordance with the present invention includes a container of one-piece integrally molded plastic construction having a cylindrical finish, a shoulder connecting the finish to a side wall, a ring externally extending around the finish, and a tab extending from the ring and separated from the finish by a tangential slot. A stop lug on the tab has oppositely oriented stop and cam faces, and at least one rib extends tangentially along an undersurface of the tab. A closure has a base wall with a peripheral skirt and an internal thread for securement to an external thread on the container finish. At least one internal lug on the skirt has a circumferentially oriented cam surface to cooperate with a cam surface on the stop lug on the container tab to bend the stop lug as the closure is applied to the container finish, and a circumferentially oriented abutment surface to cooperate with the stop face on the container stop lug against removal of the closure from the container finish absent depression of the container tab toward the container shoulder. The rib extending tangentially along the undersurface of the tab functions both to strengthen the tab during such depression and as an abutment stop against the container shoulder during bending depression of the tab to remove the closure.

In one preferred embodiment of the invention, there are a pair of parallel radially spaced ribs extending along the underside of the tab onto the underside of the ring that impart an inverted U-shaped cross section to the tab and to the ring adjacent to the tab. In another preferred embodiment, there is a single rib extending along the radially inner edge of the tab, imparting an L-shaped cross section to the tab. The stop lug on the tab in the preferred embodiments has an axially and tangentially extending first cam face, and a radially and axially extending second cam face for cooperating with the internal lug on the closure to cam the internal lug over the stop lug. The cam surface on the internal lug preferably is a compound surface having portions oriented tangentially, radially and axially of the closure for camming the stop lug on the container radially inwardly and axially downwardly as a closure is applied clockwise onto the container finish.

A child resistant container in accordance with another aspect of the invention is of one-piece integrally molded plastic construction having a sidewall, a cylindrical finish with an external thread and a shoulder connecting the sidewall to the finish. A ring extends circumferentially around the finish between the thread and the shoulder, and a tab extends tangentially from the ring and is separated from the ring by a tangential slot. A stop lug extends from the tab, and has oppositely oriented stop and cam faces. At least one rib extends tangentially along an undersurface of the tab. This rib functions both to strengthen the tab and as an abutment stop for bending depression of the tab toward the shoulder. In one preferred embodiment, there are a pair of parallel radially spaced ribs extending along the undersurface of the tab onto the underside of the ring and imparting an inverted U-shaped cross section to the tab and to the ring adjacent to the tab. In another preferred embodiment, there is a single rib extending along the radially inner edge of the tab, imparting an L-shaped cross section to the tab. The stop lug preferably has an axially and tangentially extending first cam face, and a radially and axially extending second cam face for cooperating with an internal lug on a closure to cam the stop lug and tab axially downwardly and radially inwardly with respect to the container finish.

A closure for a child resistant package in accordance with a further aspect of the invention has a base wall and a peripheral skirt with an internal thread for securement to the container finish. At least one internal lug is disposed on the skirt on a side of the thread remote form the base wall. The lug has a circumferentially oriented cam surface and a circumferentially oriented abutment surface. The cam surface on the lug preferably is at a compound surface having portions oriented tangentially, radially and axially of the closure. In the preferred embodiment, there are a pair of diametrically opposed internal lugs on opposite sides of the closure skirt.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
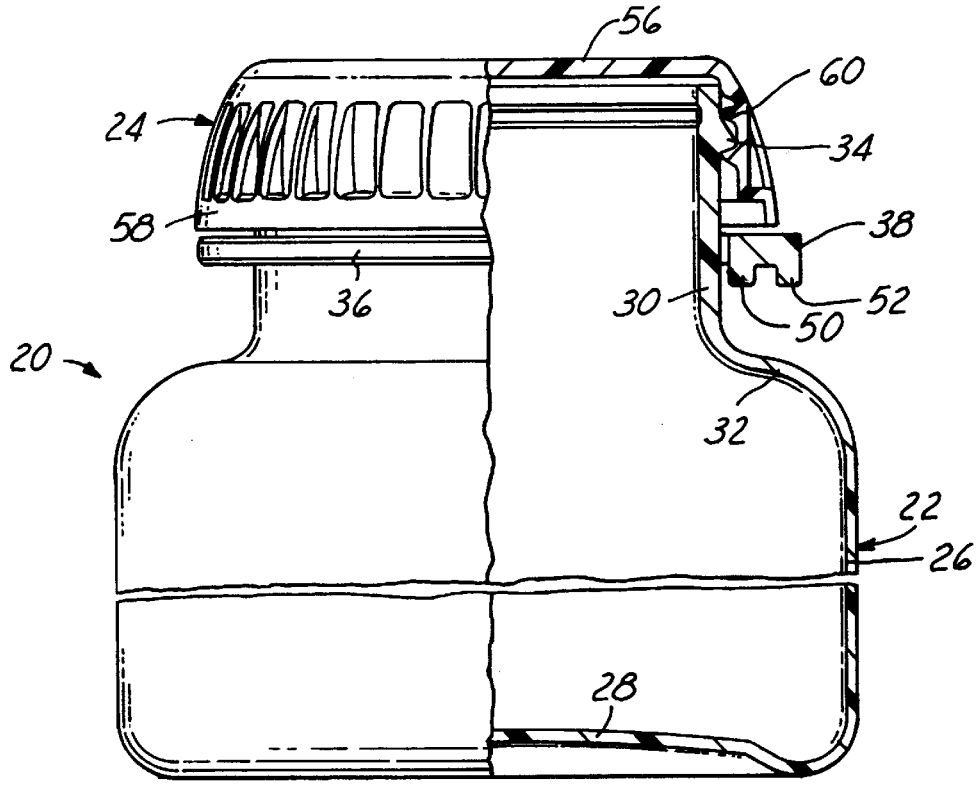
FIG. 1 is a partially sectioned fragmentary elevational view of a child resistant container and closure package in accordance with a presently preferred embodiment of the invention.
Figure 2:
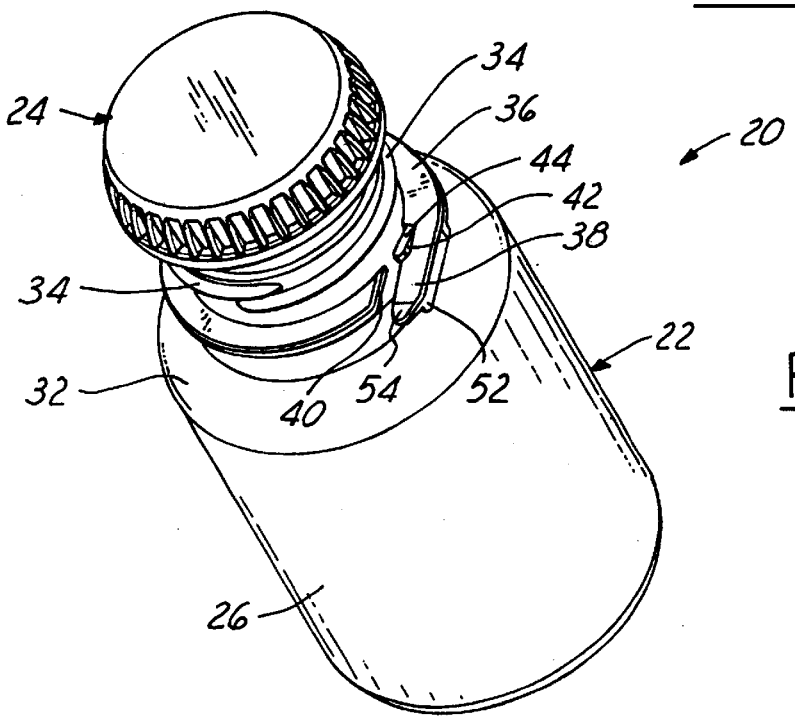
FIG. 2 is an exploded perspective view of the package illustrated in FIG. 1.
Figure 5:
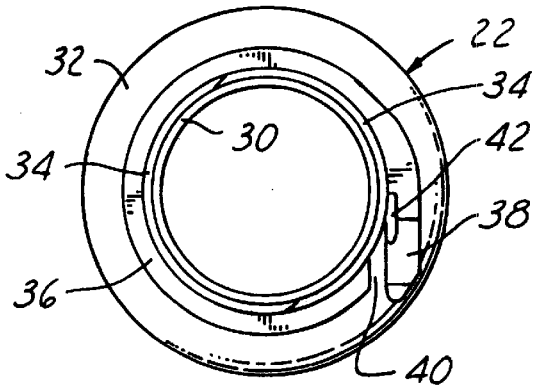
FIG. 5 is a top plan view of the container illustrated in FIGS. 3 and 4.
Figure 3:
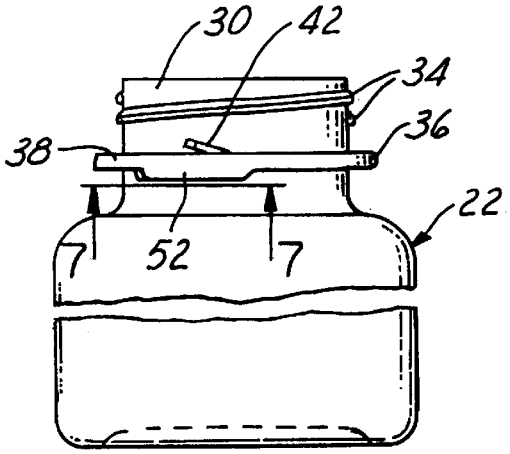
FIGS. 3 and 4 are elevational views of the container in the package of FIGS. 1 and 2.

FIGS. 1 and 2 illustrate a child resistant container and closure package 20 in accordance with a presently preferred embodiment of the invention as comprising a container 22 and a closure 24. Container 22 is of one-piece integrally molded plastic construction having a sidewall 26, a closed bottom 28 and an axially extending cylindrical finish 30. Finish 30 has a lesser diameter than sidewall 26, and is connected to sidewall 26 by a shoulder 32. A pair of part-helical external threads 34 extend around the external surface of container finish 30.

Figure 4:
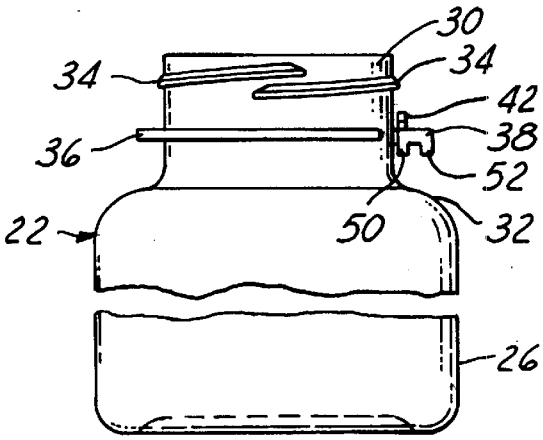
Figure 7:
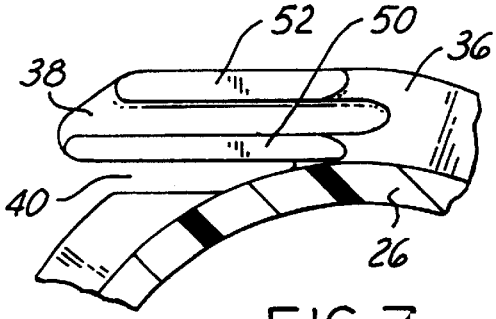
FIG. 7 is a fragmentary sectional view taken substantially along the line 7—7 in FIG. 3.
Figure 6:
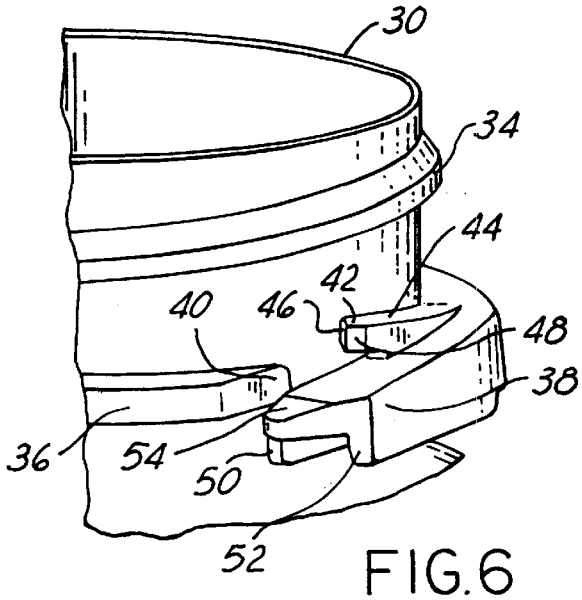
FIG. 6 is a fragmentary perspective view on an enlarged scale of a portion of the container illustrated in FIGS. 3–5.
Figure 8:
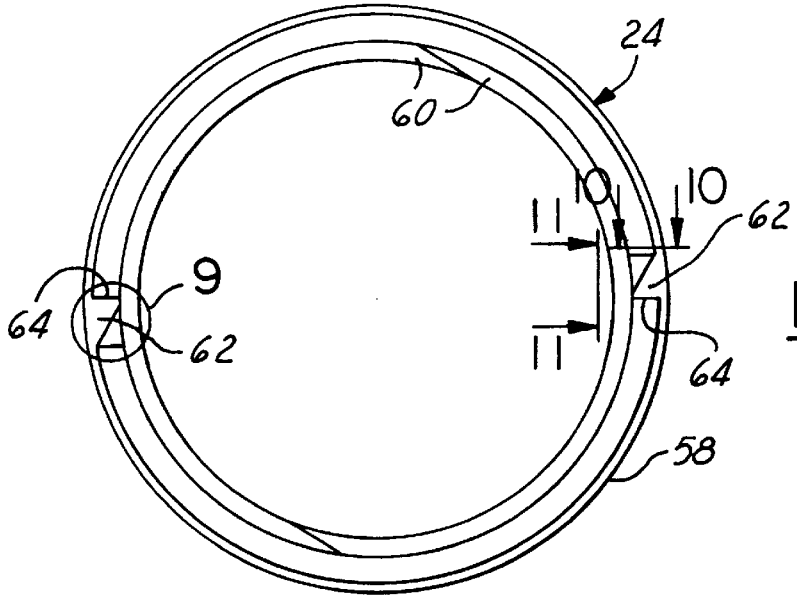
FIG. 8 is a bottom plan view of the closure in the container and closure package illustrated in FIGS. 1 and 2.

Referring to FIGS. 1–7, a ring 36 extends around the external surface of finish 30 between threads 34 and shoulder 32. Ring 36 is planar, and is perpendicular to the central axis of finish 30. A tab 38 extends tangentially from ring 36, and is separated from the external surface of container finish 30 and the opposing edge of ring 36 by a tangential slot 40. A stop lug 42 is cantilevered from the upper surface of tab 38 beneath thread 34, and is radially outwardly spaced from finish 30. Stop lug 42 is in the form of a beam that extends tangentially clockwise from the upper surface of tab 38 and axially upwardly toward thread 34, being separated from finish 30 by slot 40. Lug 42 has a flat upper cam surface 44 that extends from the flat upper surface of tab 38 axially upwardly and tangentially clockwise with respect to the axis of the container finish. The free end of lug 42 has a flat surface 46 facing circumferentially clockwise of the container finish. Extending from surface 46 along the outer surface of lug 42 is a flat surface 48 (FIG. 6) that is parallel to the axis of the container finish and at an angle to surface 46. A pair of radially spaced inner and outer ribs 50, 52 extend along the undersurface of tab 38 tangentially of the axis of the container finish onto the undersurface of ring 36 adjacent to tab 38. Ribs 50, 52 impart an inverted U-shaped cross section to tab 38 as viewed in the tangential direction (FIG.4). The free end of tab 38 has an axially downwardly beveled surface 54 to facilitate depression of the tab by a users's finger.

Figure 9:
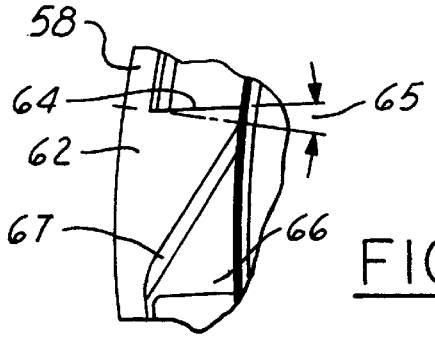
FIG. 9 is an enlarged view of the portion of FIG. 8 within the circle 9.
Figure 9A:
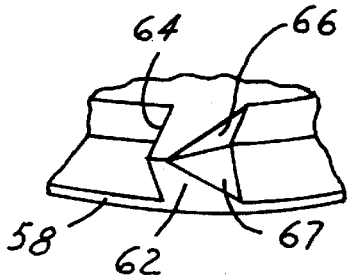
FIG. 9A is a fragmentary perspective view of the closure skirt and lug in FIGS. 8–11.
Figure 10:
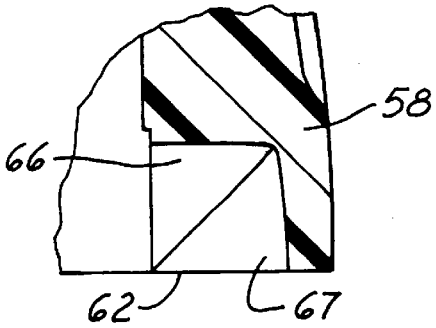
FIGS. 10 and 11 are fragmentary sectional views taken substantially along the lines 10—10 and 11—11 in FIG. 8.
Figure 11:
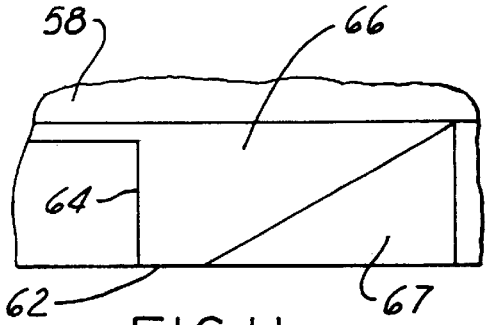

Closure 24 is of plastic construction, and includes a base wall 56 and a peripheral skirt 58 with internal part-spiral threads 60 for cooperating with threads 34 to secure closure 24 to finish 30 of container 22. Beneath threads 60—i.e., on a side of threads 60 opposite base wall 56, there are disposed a pair of diametrically opposed internal lugs 62 (FIGS. 8–11). As viewed from the bottom of the closure (FIGS. 8 and 9), each lug 62 has a clockwise-facing abutment surface 64. As best seen in FIG. 9, these abutment surfaces 64 are at a closed angle 65 with respect to the closure diameter, preferably on the order of 10°. Stop lug surface 46 is also at a 10° angle. On the opposing circumferential side of each lug 62, there is a compound cam surface 66, 67. Each surface portion 66 and 67 is essentially flat. Both surface portions face radially inwardly, axially downwardly, and circumferentially (in the orientation of FIGS. 1 and 2). Surface portion 66 is disposed radially inwardly of surface portion 67, and is more axially downwardly facing the surface portion 67. Surface portion 67 is disposed radially outwardly of surface portion 66, and is more radially inwardly facing than surface portion 66.

To apply closure 24 to container 22, after filling the container with product such as vitamin tablets, the closure is rotated clockwise (as viewed from above) onto the container finish threads. When a lug 62 on the closure engages lug 42 on container tab 38, this initial engagement will be between angulated compound surface 66,67 on lug 62 and angulated surfaces 44, 48 on lug 42. Continued clockwise rotation cams lug 42 radially inwardly and axially downwardly so that skirt lug 62 rides over and clears container lug 42. Continued clockwise rotation to tighten the closure brings closure skirt 58 into position closely adjacent to finish ring 36. The outside diameter of ring 36 is the same as the outside diameter at the free edge of skirt 58, as best seen in FIG. 1. Thus, ring 36 helps prevent engagement of the underside of the closure skirt by a child's teeth or a pry tool. To remove closure 24, the closure is rotated counterclockwise (as viewed from above) with respect to the container finish. Such counterclockwise rotation will bring abutment surface 60 of lug 62 into opposed abutment with abutment face 46 of lug 42 and prevent removal of the closure. The angulated orientation of skirt lug surfaces 64 and 46 tends to bend finish lug 42 radially outwardly against the opposing internal surface of closure skirt 58, so that increased turning force on the closure increases the locking force on the closure. To enable removal of the closure, the free edge of tab 38 is pressed downwardly with respect to the closure finish and ring 36. Such downward bending of tab 38 carries stop lug 42 downwardly with the tab, allowing closure lug 62 to clear the stop tab and permitting continued counterclockwise rotation of the closure to remove the closure.

Figure 12:
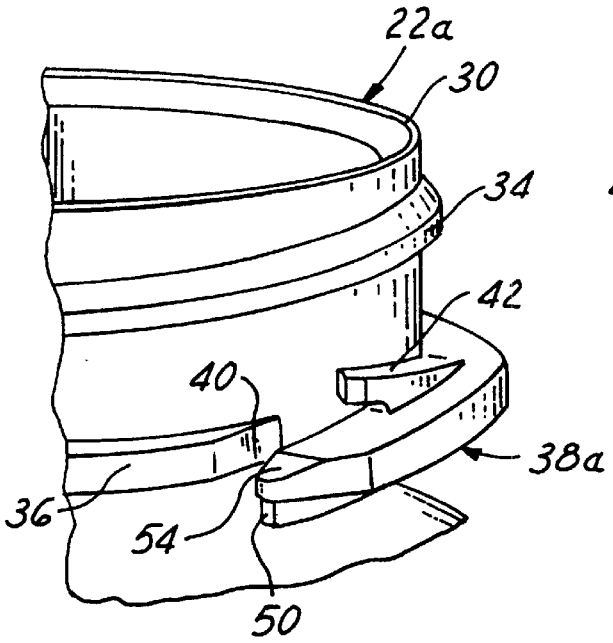
FIGS. 12 and 13 are views similar to those of FIGS. 6 and 7 but illustrating a modified embodiment of the invention.
Figure 13:
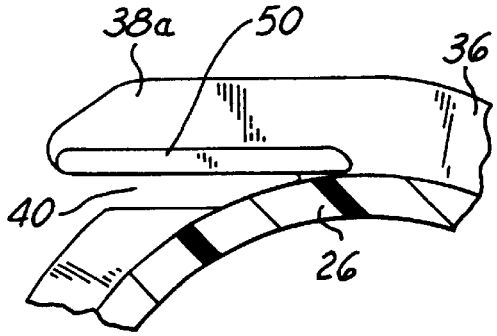

FIGS. 12 and 13 illustrate a modified container 22*a,* in which a tab 38*a* has a single rib 50 on the radially inner edge of its undersurface. That is, outer rib 52 has been deleted in the embodiment of FIGS. 12 and 13, giving tab 38*a* a generally L-shaped cross section. Container 22*a* in FIGS. 12 and 13 is otherwise identical to the embodiment of FIGS. 1–7.

The container and closure package, the container and the closure disclosed above possess a number of significant advantages. The container can be manufactured using conventional processes, such as injection blow molding processes using standard neck ring technology in which the container finish can be formed by straight pull from the neck rings. The neck rings do not require any secondary actions, which allows use of high production molds. Lugs 62 on closure 24 and lug 42 on container tab 38 require minimal application force. The circular closure motion and the force associated with such motion are redirected to axial and radial forces resiliently to bend lug 42 radially inwardly and axially downwardly and permit passage of closure lug 62. The inverted U-shaped or L-shaped cross section of tab 38 or 38*a* strengthens the underside of the tab and allows use of relatively low E-modular plastic for the package, such as high density polyethylene. Ribs 50, 52, or rib 50 alone, also function in conjunction with container shoulder 32 to limit downward bending of tab 38 and potential over-stressing of the tab. The disclosed container and closure package employs a two lead thread system that allows removal of the closure with approximately 180° of rotation.

There have thus been disclosed a container and closure package, a container, a closure, and a method of fabrication that fully satisfy all of the objects and aims previously set forth. The invention has been disclosed in conjunction with a presently preferred embodiment, and a number of modifications and variations have been discussed. Other modifications and variations will readily suggest themselves to persons of ordinary skill in the art. The invention is intended to embrace all such modifications and variations as fall within the spirit and broad scope of the appended claims.

What is claimed is:

1. A child resistant container and closure package that includes:

a container of one-piece integrally molded plastic construction having a sidewall, a cylindrical finish with an external thread, a shoulder connecting said sidewall to said finish, a ring extending circumferentially around said finish between said thread and said shoulder, a tab extending tangentially from said ring and being separated from said finish by a tangential slot, a stop lug cantilevered from said tab and having oppositely oriented stop and cam faces, and at least one rib extending tangentially along an undersurface of said tab, said rib functioning both to strengthen said tab and as an abutment stop for bending depression of said tab toward said shoulder, and a closure having a base wall, a peripheral skirt with an internal thread for securement to said external thread, and at least one internal lug on said skirt on a side of said thread remote from said base wall, said lug having a circumferentially oriented cam surface to cooperate with said cam surface in said stop lug to bend said stop lug on said tab as said closure is applied to said finish, and a circumferentially oriented abutment surface to cooperate with said stop face of said stop lug against removal of said closure from said finish absent depression of said tab toward said shoulder.

2. The package set forth in claim 1 wherein said at least one rib extends tangentially along an underside of said tab onto an underside of said ring adjacent to said tab.

3. The package set forth in claim 2 wherein said at least one rib comprises a pair of parallel radially spaced ribs extending along an underside of said tab onto an underside of said ring and imparting an inverted U-shaped cross section to said tab and said ring adjacent to said tab.

4. The package set forth in claim 2 wherein said at least one rib extends along a radially inner edge of said tab, imparting an L-shaped cross section to the tab.

5. The package set forth in claim 1 wherein said stop lug has an axially and tangentially extending first cam face, and a radially and axially extending second cam face for cooperating with said internal lug on said closure to cam said internal lug over said stop lug.

6. The package set forth in claim 5 wherein said cam surface on said internal lug is a compound surface having portions at an angle to each other and facing tangentially, radially and axially of said closure.

7. A child resistant container of one-piece integrally molded plastic construction having a sidewall, a cylindrical finish with an external thread, a shoulder connecting said sidewall to said finish, a ring extending circumferentially around said finish between said thread and said shoulder, a tab extending tangentially from said ring and being separated from said finish by a tangential slot, a stop lug cantilevered from said tab and having oppositely oriented stop and cam faces, and at least one rib extending tangentially along an undersurface of said tab, said rib functioning both to strengthen said tab and as an abutment stop for bending depression of said tab toward said shoulder.

8. The container set forth in claim 7 wherein said at least one rib extends tangentially along an underside of said tab onto an underside of said ring adjacent to said tab.

9. The container set forth in claim 8 wherein said at least one rib comprises a pair of parallel radially spaced ribs extending along an underside of said tab onto an underside of said ring and imparting an inverted U-shaped cross section to said tab and said ring adjacent to said tab.

10. The container set forth in claim 8 wherein said at least one rib extends along a radially inner edge of said tab, imparting an L-shaped cross section to the tab.

11. The container set forth in claim 7 wherein said stop lug has an axially and tangentially extending first cam face, and a radially and axially extending second cam face for cooperating with said internal lug on said closure to cam said internal lug over said stop lug.

12. A closure for a child resistant package having a base wall, a peripheral skirt with an internal thread, and diametrically opposed internal lugs on said skirt on a side of said thread remote from said base wall, each said lug having a circumferentially oriented cam surface and a circumferentially oriented abutment surface, wherein said cam surface on said internal lug is a compound surface having portions at an angle to each other and facing tangentially, radially and axially of said closure.

13. A method of assembling a child resistant container and closure package that includes the steps of:

(a) providing a container of one-piece integrally molded plastic construction having a sidewall, a cylindrical finish with an external thread, a shoulder connecting said sidewall to said finish, a ring extending circumferentially around said finish between said thread and said shoulder, a tab extending tangentially from said ring and being separated from said finish by a tangential slot, a stop lug cantilevered from said tab and having oppositely oriented stop and cam faces, and at least one rib extending tangentially along an undersurface of said tab, said rib functioning both to strengthen said tab and as an abutment stop for bending depression of said tab toward said shoulder, (b) providing a plastic closure having a base wall, a peripheral skirt with an internal thread for securement to said external thread, and at least one internal lug on said skirt on a side of said thread remote from said base wall, said lug having a circumferentially oriented cam surface to cooperate with said cam surface of said stop lug to bend said stop lug on said tab as said closure is applied to said finish, and a circumferentially oriented abutment surface to cooperate with said stop face of said stop lug against removal of said closure from said finish absent depression of said tab toward said shoulder, and (c) threading said closure onto said container finish such that said cam surface on said internal lug bends said stop lug, said stop lug preventing removal of said closure from said container absent depression of said tab toward said shoulder until said internal lug clears said stop lug.

* * * * *